US008499754B2

(12) United States Patent
Vergin

(10) Patent No.: US 8,499,754 B2
(45) Date of Patent: Aug. 6, 2013

(54) ARROW SECURING DEVICES AND QUIVERS AND METHODS OF USE THEREOF

(76) Inventor: Evan M Vergin, New Castle, CO (US)

( * ) Notice: Subject to any disclaimer, the term of this patent is extended or adjusted under 35 U.S.C. 154(b) by 223 days.

(21) Appl. No.: 13/176,981

(22) Filed: Jul. 6, 2011

(65) Prior Publication Data

US 2012/0085667 A1 Apr. 12, 2012

Related U.S. Application Data

(63) Continuation-in-part of application No. 12/900,313, filed on Oct. 7, 2010.

(51) Int. Cl.
*F41B 5/14* (2006.01)
*F41B 5/06* (2006.01)

(52) U.S. Cl.
CPC .. *F41B 5/14* (2013.01); *F41B 5/066* (2013.01)
USPC ..... 124/86; 124/1; 206/315.11

(58) Field of Classification Search
CPC ..... F41B 5/14; F41B 5/066
USPC ..... 124/1, 86
See application file for complete search history.

(56) References Cited

U.S. PATENT DOCUMENTS 2,587,155 A * 2/1952 Harvey ..... 206/315.11
3,209,740 A * 10/1965 Hauch ..... 124/25.7
3,397,026 A * 8/1968 Spina ..... 351/157
3,696,978 A * 10/1972 Gentellalli ..... 206/315.11
4,133,427 A * 1/1979 Loomis ..... 206/317
4,247,027 A * 1/1981 Tardiff ..... 224/197
4,783,164 A * 11/1988 Heiberger ..... 351/156
4,955,473 A * 9/1990 Van Hout et al. ..... 206/315.11
4,958,758 A * 9/1990 Tipple et al. ..... 224/267
4,995,372 A * 2/1991 Topel ..... 124/25.5
5,020,192 A * 6/1991 Gerlach ..... 24/136 R
5,087,118 A * 2/1992 Gill ..... 351/156
5,215,070 A * 6/1993 Brown ..... 124/88
5,246,154 A * 9/1993 Adams et al. ..... 224/257
5,511,293 A * 4/1996 Hubbard et al. ..... 24/442
5,541,676 A * 7/1996 Pallat ..... 351/156
5,664,721 A 9/1997 Homeyer
5,979,726 A 11/1999 Chisholm
6,050,252 A * 4/2000 Etheridge ..... 124/86
6,092,897 A * 7/2000 Smerdon, Jr. ..... 351/157
6,182,875 B1 * 2/2001 Fareghi ..... 224/259
6,295,976 B1 10/2001 Runde
6,513,171 B1 * 2/2003 Soper ..... 2/436
6,564,791 B1 * 5/2003 Hammen ..... 124/86

(Continued)

*Primary Examiner* — Gene Kim
*Assistant Examiner* — Alexander Niconovich
(74) *Attorney, Agent, or Firm* — Albert Haegele; Leyendecker & Lemire, LLC

(57) ABSTRACT

Arrow securing devices and quivers along with various methods of using and making the same are disclosed herein. An exemplary arrow securing device typically includes a cord, one or two nock coupling end. Additionally, the exemplary arrow securing device typically includes a locking mechanism and a one of an anchor point and an anchor member operatively coupled to the cord. Each nock coupling end is typically located proximal an end of the cord. The locking mechanism can be connected to the cord and is releasably lockable. The one of the anchor point and the anchor member is adapted to couple the cord to a portion of a quiver. Arrow securing devices having the locking mechanism or the one of an anchor point and an anchor member, such as a hooking mechanism, can be attached to various portions of a quiver.

19 Claims, 14 Drawing Sheets

U.S. PATENT DOCUMENTS

| | | | | |
|---|---|---|---|---|
| 6,941,619 | B2 * | 9/2005 | Mackay et al. | 24/3.3 |
| 7,014,210 | B2 | 3/2006 | Manninen | |
| 7,275,396 | B2 * | 10/2007 | MacHock | 63/14.1 |
| 2003/0141335 | A1 * | 7/2003 | Fleming et al. | 224/613 |
| 2006/0209533 | A1 * | 9/2006 | Druzin | 362/108 |
| 2007/0080023 | A1 | 4/2007 | Matheny | |
| 2007/0114095 | A1 * | 5/2007 | Swierski et al. | 182/9 |
| 2007/0284504 | A1 | 12/2007 | Cross | |
| 2008/0060170 | A1 * | 3/2008 | Wagner | 24/129 R |
| 2009/0083947 | A1 | 4/2009 | Kubli | |

* cited by examiner

ARROW SECURING DEVICES AND QUIVERS AND METHODS OF USE THEREOF

CROSS-REFERENCE TO RELATED APPLICATIONS

This application is a continuation-in-part of and claims priority to U.S. Nonprovisional patent application Ser. No. 12/900,303 filed Oct. 7, 2010, the full disclosure of which is incorporated herein by reference. The aforementioned non-provisional patent application has the title "Arrow Securing Device and Methods Thereof" and has the same named inventor as the present application.

FIELD OF THE INVENTION

The present invention relates generally to archery and bow hunting. More particularly, the present invention relates to devices and methods for securing arrows within a quiver or the like.

BACKGROUND

Bow hunting requires extreme stealth on the part of the hunter. The difference between a trophy stag and fleeing prey can be the barely audible "rattling" sound of two or more arrows contacting each other. Whether on the move following the trail of the prey, still-hunting, or bow hunting from a tree stand, even a minuscule amount of noise will alert the prey of the presence of the hunter. For example, while still-hunting or bow hunting from a tree stand event making slow movements can cause a shift in the quiver such that the plurality of arrows will rattle. Moreover, when bow hunting from the ground, the hunter often must carefully and quietly move toward the prey to get to a spot having a clear and unobstructed path for the arrow to hit a kill zone on the prey.

Additionally, there are times when a hunter must sprint after his prey and/or climb to a desired position to get a clean shot or stake out the prey. In addition to increasing noise caused by rattling arrows within the quiver, it is not uncommon that a bow hunter will lose several of his arrows during such swift, but strenuous, hastened activities. Moreover, poorly secured arrows can be a major safety concern, particularly when arrows with razor sharp tips are used by novice or young bow hunters. While quivers and grippers for arrows provide some securing of the arrows therein, more stability and securing of arrows is required.

Heretofore, devices and methods for better stabilizing and securing arrows to eliminate the rattling noise caused from two or more arrows contacting each other, to retain arrows during the hunt, and to alleviate the safety concerns of bow hunting remains a long felt need.

DETAILED DESCRIPTION

Figure 1:
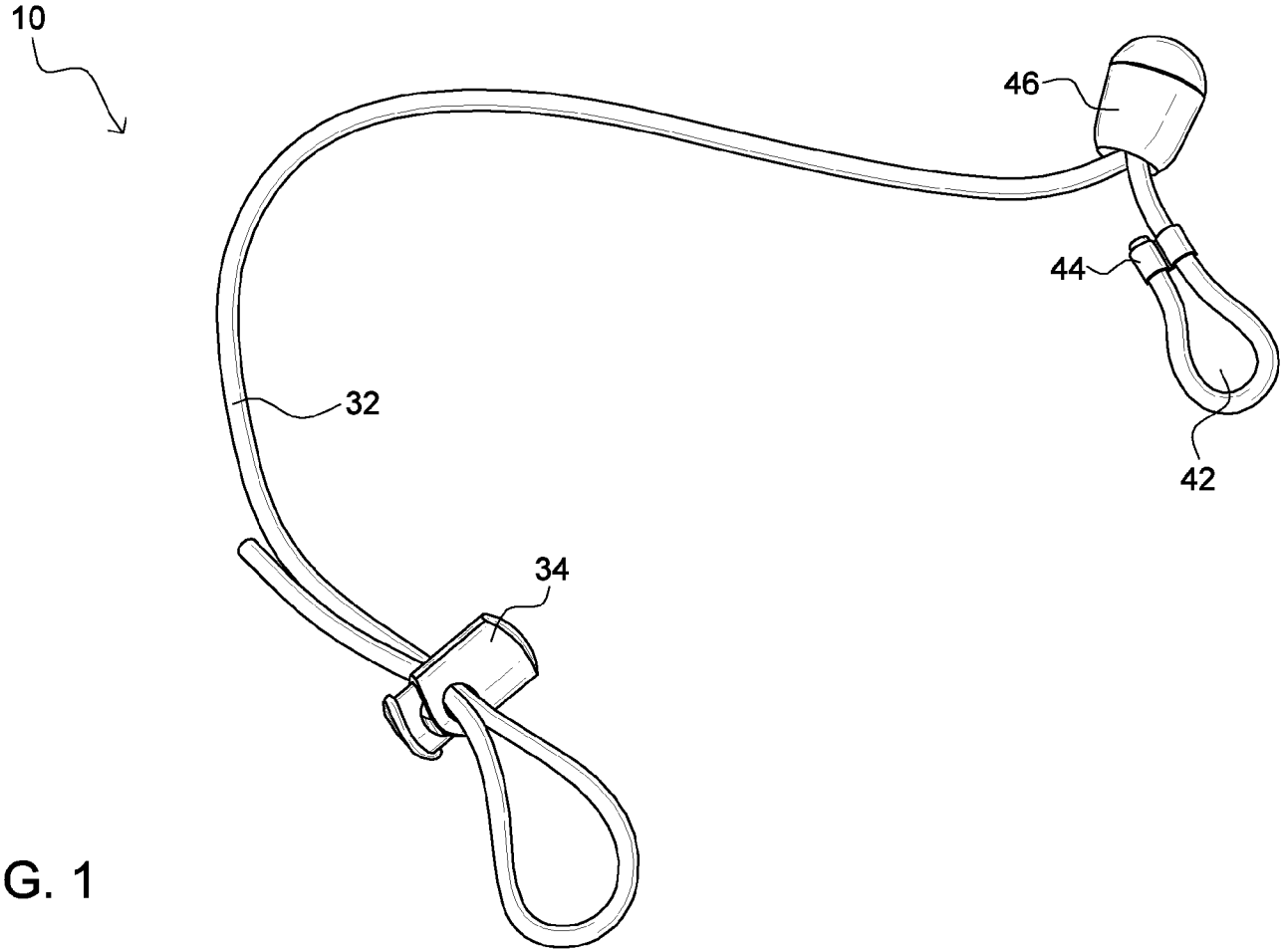
FIG. 1 is a perspective view of an arrow securing device according to a first embodiment.

Embodiments of the present invention comprise devices for securing arrows or crossbow bolts by their nock ends. Embodiments of an arrow securing device basically comprise a cord, typically a stretchable resilient cord, and at least one nock coupling end. Additionally, the arrow securing device typically comprises a locking mechanism or an anchor point or member. Some arrow securing devices can be directly coupled to or integrated with a quiver thereby creating novel arrow securing quivers.

The cord of the arrow securing device typically has a first end, a second end, and a longitudinal section disposed therebetween. The at least one nock coupling end is disposed proximal either the first or second end of the cord. In some embodiments, a first coupling end will be disposed proximal the first end of the cord and a second coupling end will be disposed proximal the second end. Hence, embodiments of the arrow securing device typically comprise either one or two nock coupling ends; however, embodiments are contemplated whereby three or more nock coupling ends are utilized for one arrow securing device. The locking mechanism can be operatively coupled to the longitudinal section of the cord. Similarly, the anchor member can be operatively coupled to the longitudinal section of the cord, or alternatively to an end of the cord.

Many variations of the nock coupling end are described herein. For example, the nock coupling end can be a loop secured by a clasp for attaching to the nock of an arrow. Other variations include, but are not limited to, a bored bead secured by a knot, a tab member disposed at an end of the cord, and a combination loop and a tab member. The locking mechanism is releasably lockable to the cord. When an embodiment includes only one nock coupling end, the locking mechanism is typically connected to one portion of the cord, but the end without the nock coupling end can be looped back into the locking mechanism. However when an embodiment includes two nock coupling ends, the locking mechanism is typically connected to two portions of the cord creating a loop.

When in use, the locking mechanism or anchor member of the arrow securing device operates basically as an anchor point secured to a portion of a quiver. However, in some embodiments, the cord may be tied to a portion of the quiver or integrated therewith. The nock coupling end(s) are typically attached to the nocks of the arrows within the quiver; however, in some embodiments can be attached to a nock lid adapted to couple to a plurality of arrow nocks. By releasing the locking mechanism, the cord can be moved up or down thereby varying the tension applied to the arrow nock(s). Additionally, where an anchor point or member couples the arrow securing device to the quiver, the cord can be of a fixed length customized for specific quiver types and arrow lengths.

The advantages of using embodiments of the arrow securing device are many. An unsecured arrow can make noise while hunting, can become lost, and can cause damage or injury. For example, when a bow quiver is utilized to stow a razortip broadhead arrow, if the arrow becomes dislodged from the gripper assembly of the bow quiver, which can happen quite easily particularly when the arrow is relatively short in length then the arrow tip can nick or completely cut the bowstring or even slice the hunter's hand, arm or leg. It is to be appreciated that in cold and/or rainy weather the gripper assemblies, typically comprised of rubber, substantially lose their ability to grip or clasp arrow shafts and secure the arrow without the aid of arrow securing devices.

When an arrow is secured with embodiments of the arrow securing device, the arrow or arrows are more securely stowed in the quiver. For example, with all arrows secured in the quiver such as a bow quiver or back quiver with arrow securing devices, the quiver can be turned upside down and even violently shaken without dislodging a single arrow. Such secure stowing can be particularly important when a bow hunting user is active and mobile, such as when climbing a tree, scaling a ledge, and chasing after prey. Moreover, arrow securing devices keep the user stealthy throughout the hunt by eliminating any noise caused from the plurality of arrows coming in contact with each other while in the arrow quiver. Additionally, safety concerns are addressed when arrow securing devices are used, particularly when hunting with razortip broadhead arrows. For example, embodiments of the arrow securing device keep arrows can be used to keep arrows securely stowed during transport to and from a hunt and/or target practice session (e.g., transporting by automobile or airplane), or during a walk or extended hike while the quiver is being carried by the user.

Terminology

The terms and phrases as indicated in quotes (" ") in this section are intended to have the meaning ascribed to them in this Terminology section applied to them throughout this document including the claims unless clearly indicated otherwise in context. Further, as applicable, the stated definitions are to apply, regardless of the word or phrase's case, to the singular and plural variations of the defined word or phrase.

The term "or" as used in this specification and the appended claims is not meant to be exclusive rather the term is inclusive meaning: either or both.

References in the specification to "one embodiment", "an embodiment", "an alternative embodiment" and similar phrases mean that a particular feature, structure, or characteristic described in connection with the embodiment is included in at least an embodiment of the invention. The appearances of the phrase "in one embodiment" in various places in the specification are not necessarily all meant to refer to the same embodiment.

The term "couple" or "coupled" as used in this specification and the appended claims refers to either an indirect or direct connection between the identified elements, components or objects. Often the manner of the coupling will be related specifically to the manner in which the two coupled elements interact.

The term "removable," "removably coupled," "readily removable," "threadably coupled," and similar terms, as used in this specification and appended claims, refer to structures that can be uncoupled from an adjoining structure with relative ease (i.e., non-destructively and without complicated or time consuming process), and can also be readily reattached or coupled to the previously adjoining structure.

Directional and/or relationary terms such as, but not limited to, left, right, top, bottom, vertical, horizontal, back, front and lateral are relative to each other and are dependent on the specific orientation of an applicable element or article, and are used accordingly to aid in the description of the various embodiments and are not necessarily intended to be construed as limiting.

As applicable, the terms "about" and "generally" as used herein unless otherwise indicated mean a margin of +−20%. Also, as applicable, the term "substantially" as used herein unless otherwise indicated means a margin of +−10%. Concerning angular measurements, "about" or "generally" refer to +−10 degrees and "substantially" refers to +−5.0 degrees unless otherwise indicated. It is to be appreciated that not all uses of the above terms are quantifiable such that the referenced ranges can be applied.

A First and Second Embodiment of an Arrow Securing Device and Variations Thereof Exemplary embodiments of an arrow securing device including many variations and uses thereof are illustrated in FIGS. 1-12. Specifically, one version of a first embodiment arrow securing device 10 is best illustrated in FIG. 1. The first embodiment arrow securing device 10 typically comprises: a stretchable resilient cord 32, a nock coupling end, and a locking mechanism 34. The cord 32 can be a single length of cord having a first end, a second end, and a longitudinal section disposed therebetween. The nock coupling end is disposed proximal either the first or second end of the cord 32. The locking mechanism 34 is operatively coupled to the longitudinal section of the cord 32 and releasably lockable thereto. Typically, the locking mechanism 34 includes a clamping aperture through which the cord 32 can be passed, and then clamped and loosened.

Still referring to FIG. 1, the nock coupling end of the first embodiment arrow securing device 10 can comprise an attachment loop 42 secured by a clasp 44, and a tab member 46. The tab member 46 can be disposed proximal the attachment loop 42 to facilitate removal of the attachment loop when the first embodiment arrow securing device 10 is removably coupled to an arrow. As the tab member 46 is relatively close to the end of the cord 32 comprising the nock coupling end, the tab member is distal the other of the two ends of the cord 32. It is to be appreciated that the nock coupling end of the first embodiment arrow securing device can comprise numerous coupling ends described herein and other equivalent coupling ends not expressly described.

The cord 32 is typically comprised of elastic or one or more elastic strands, but can be any suitable flexible and stretchable material. In some implements, the cord can further comprise a nylon cover to maximum resistance to weather and abrasion. Additionally, the cord can be a shock cord or a similar type of stretchable resilient material. Depending on the particular implementation, the cord 32 can be different lengths and thicknesses as well as comprise different degrees of elasticity. However, in some embodiments it is contemplated that the cord may not be comprised of a stretchable resilient material and may exhibit little or no elasticity.

The cord 32 can be looped on the end that does not have the nock coupling end by clamping two portions of the longitudinal section with the locking mechanism 34 as illustrated in FIG. 1. Alternatively, the cord can be passed through the locking mechanism and be in contact with the cord on only one portion of the longitudinal section.

Figure 2:
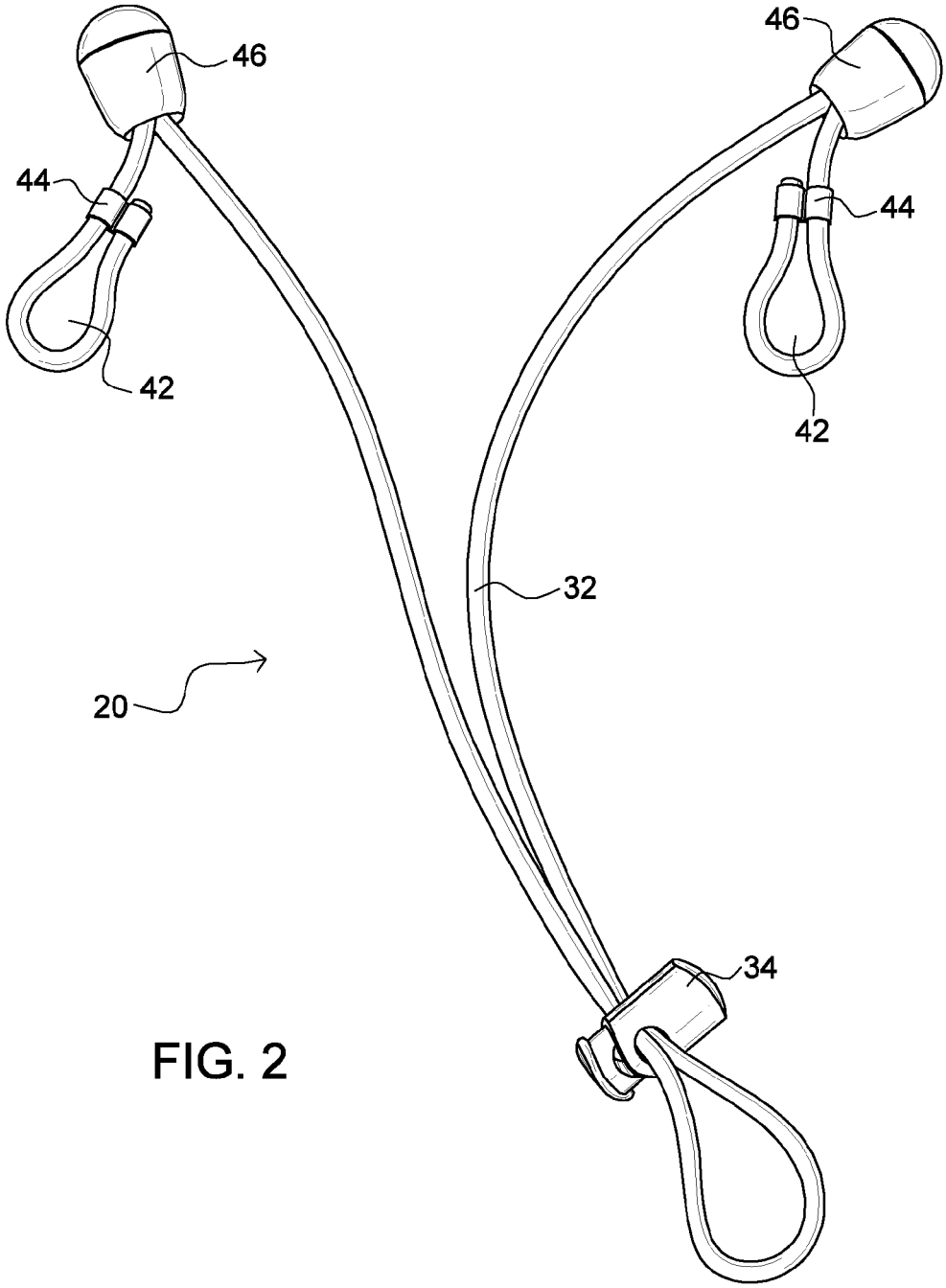
FIG. 2 is a perspective view of an arrow securing device according to a second embodiment.

Now with reference to FIG. 2, a second embodiment arrow securing device 20 is illustrated. The second embodiment arrow securing device 20 comprises: a stretchable resilient cord 32, a first nock coupling end, a second nock coupling end, and a locking mechanism 34. The cord 32 can be a single length of cord having a first end, a second end, and a longitudinal section disposed therebetween. The first nock coupling end is disposed proximal the first end of the cord 32 and the second nock coupling end is disposed proximal second end. Similar to the first embodiment, the locking mechanism 34 is operatively coupled to the longitudinal section of the cord 32 and releasably lockable thereto. Typically, the locking mechanism 34 includes a clamping aperture through which the cord 32 can be passed, and then clamped and loosened.

As shown in FIG. 2, the first and second nock coupling ends of the second embodiment arrow securing device 20 can each comprise an attachment loop 42 secured by a clasp 44, and a tab member 46. However, in variations of the second embodiment arrow securing device, the first and second nock coupling ends can comprise different types of coupling ends. The tab member 46 can be disposed proximal the attachment loop 42 to facilitate removal of the attachment loop when the second embodiment arrow securing device 20 is removably coupled to an arrow. As the tab member 46 is relatively close to the end of the cord 32 comprising the nock coupling end, the tab member is distal the other of the two ends of the cord 32. In addition to being different types of coupling ends, it is to be appreciated that the first and second nock coupling ends of the second embodiment arrow securing device can comprise numerous coupling ends described herein and other equivalent coupling ends not expressly described.

Again, the cord 32 is typically comprised of elastic or one or more elastic strands, but can be any suitable flexible and stretchable material. In some implements, the cord can further comprise a nylon cover to maximum resistance to weather and abrasion. Additionally, the cord can be a shock cord or a similar type of stretchable resilient material; however, the cord may not be stretchable and resilient in other embodiments. The cord 32 is typically looped by clamping two portions of the longitudinal section with the locking mechanism 34 as illustrated in FIG. 2. When in use, the loop formed by the locking mechanism can be pulled while pressing the locking mechanism so as to adjust the amount of tension applied to the arrow or arrows being secured by the second embodiment arrow securing device.

Figure 3A:
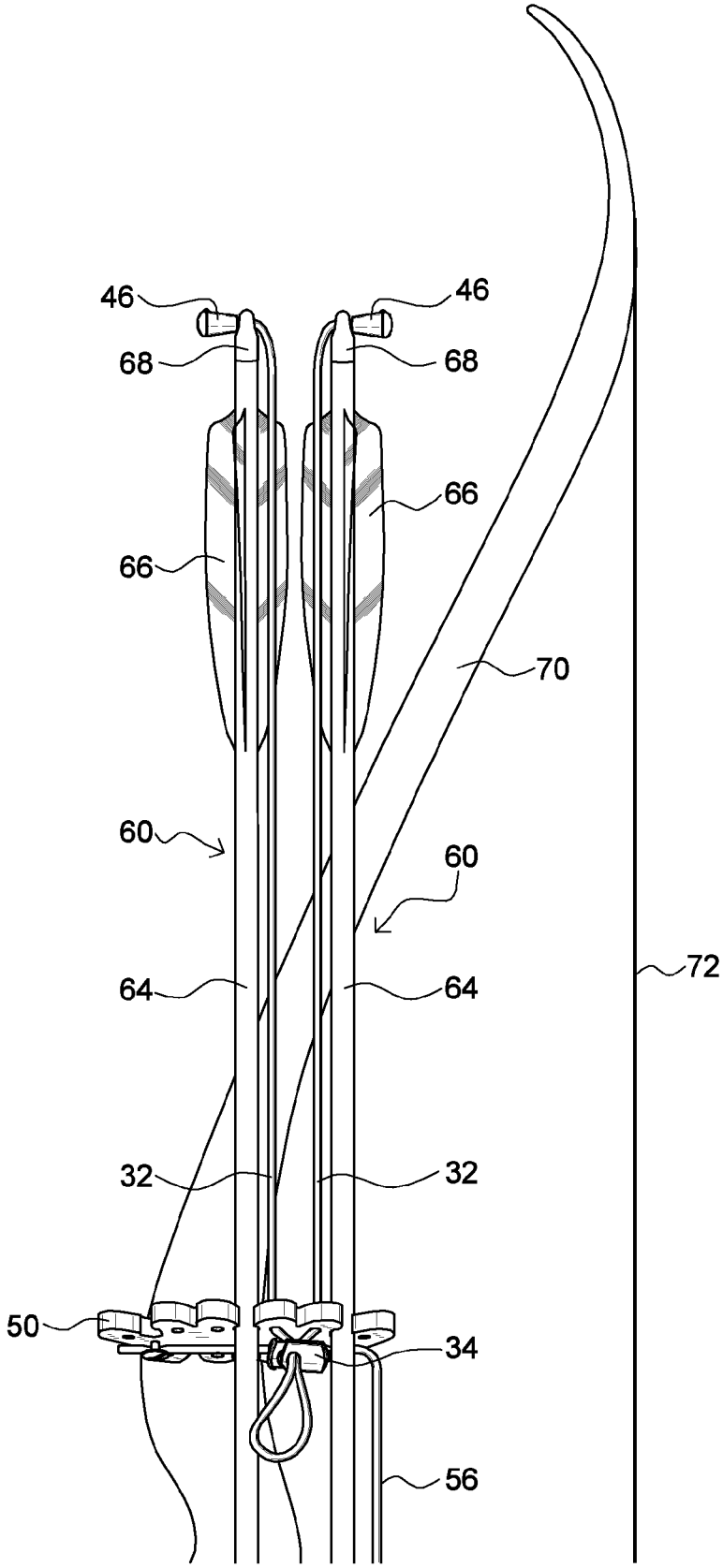
FIG. 3A is a side perspective view of an arrow securing device coupled to a quiver attached to a bow and two arrow nocks according to an embodiment.
Figure 3B:
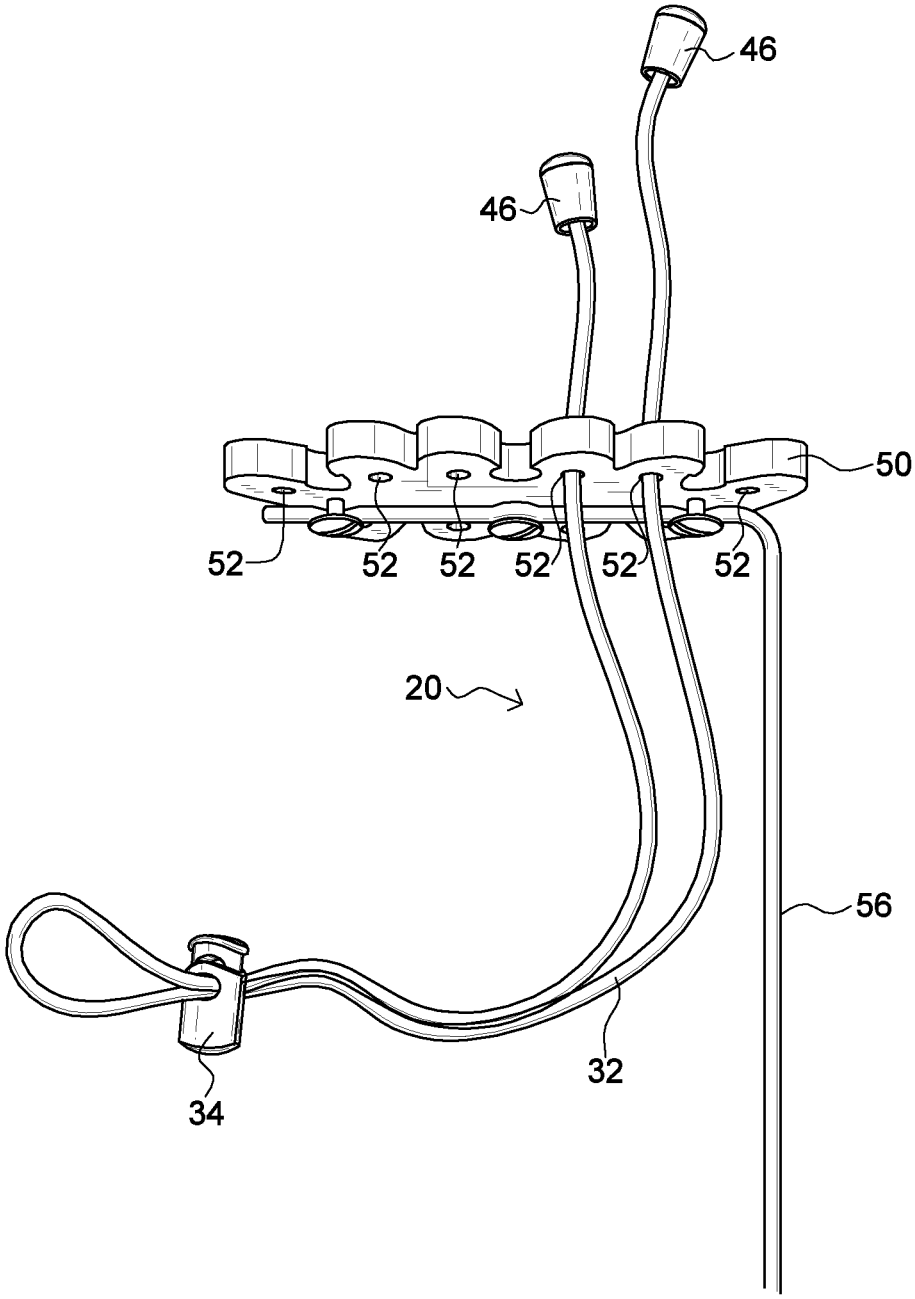
FIG. 3B is a close-up view of an arrow securing device coupled to a gripper assembly of a quiver according to an embodiment.
Figure 4:
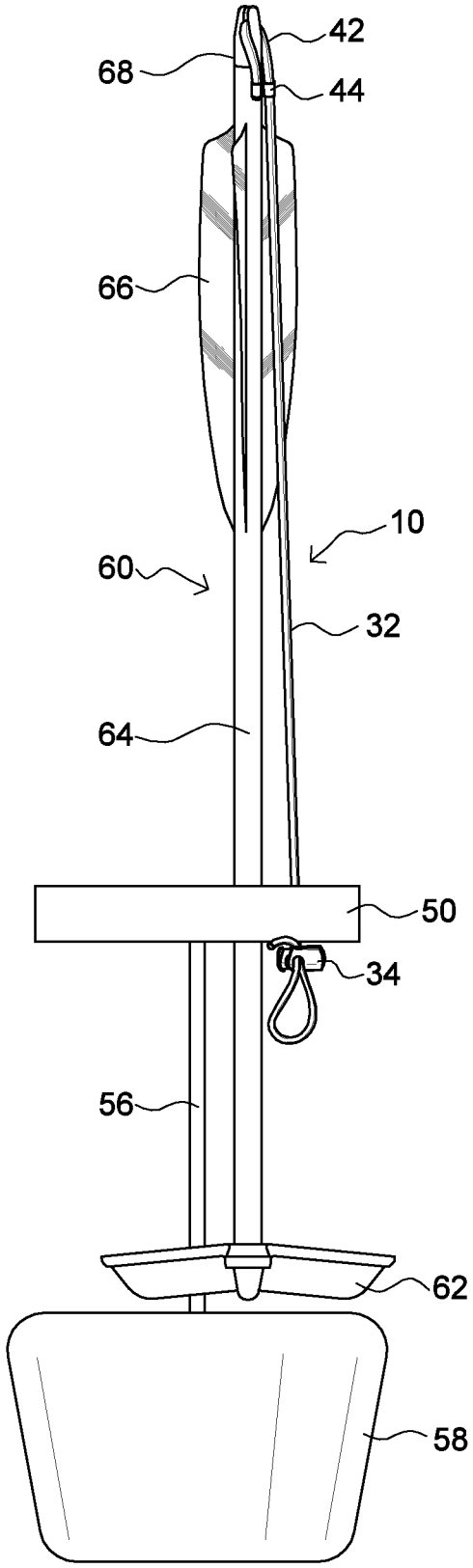
FIG. 4 is a side perspective view of an arrow securing device coupled to a quiver attached to a bow and an arrow nock according to an embodiment.

Now referring to FIGS. 3A, 3B, and 4, the first and second embodiment arrow securing devices 10, 20 are illustrated in use with a quiver. The first and second embodiment arrow securing devices can be used in combination with any type of quiver generally defined as an apparatus adapted to hold or stow arrows. For example, the quiver used with the arrow securing devices can be a back quiver (see FIG. 10) or quivers that can be secured directly to a bow (e.g., a solid mount or detachable archery quiver).

As best illustrated in FIG. 3A, the quiver can be attached directly to a bow 70 proximal the bow quiver's gripper assembly 50. The quiver, the full length of which can be seen in FIG. 4, includes the gripper assembly 50 and a hood member 58 for receiving a tip end of one or more arrows 60. The hood member 58 typically includes a foam bottom with which to receive the tip ends. As illustrated, the hood member 58 is typically coupled to the gripper assembly 50 by way of a support arm 56.

One or more arrows 60 can be secured by the quiver. Each arrow typically comprises an elongated shaft 64 having a tip 62 at a front end and a fletching 66 and nock 68 at a back end. However, various types of arrows having similarly disposed but slightly different sections are contemplated for use with embodiments of the arrow securing device. For example, the tip or head of the arrow can be, but is not limited to, a razortip broadhead illustrated in FIG. 4 with its cover thereon, target point, field point, fixed-blade broadhead, expandable-blade broadhead, turkey heads, small game heads, and blunts.

Referring back to FIG. 3A, one or more arrows 60 can be secured in the quiver with the second embodiment arrow securing device 20. The shaft 64 of each arrow 60 can be placed in spacer sections typically disposed along the circumferential edge of the griper assembly 50. Then, with the second embodiment arrow securing device 20 attached in place to the gripper assembly 50, the first and second nock coupling ends can be removably coupled to the one or more arrows 60 in the quiver. A section of the cord 32 extends from the gripper assembly 50 to the back end of one arrow 60 whereby the first nock coupling end engages with the nock 68 of one arrow. Another section of the cord 32 extends from the gripper assembly 50 to the back end of the other arrow 60 whereby the second nock coupling end engages with the nock 68 of the other arrow.

Also pertinent to note is that that the first and second nock coupling ends of the second embodiment arrow securing device 20 in the version illustrated in FIG. 3A comprises a tab member 46 at the end of the cord 32. A small section of the cord 32 is slotted into the nock 68 where the bow string 72 would go when the arrow 60 is being shot. The tab member 46 acts as a stopper to prohibit the nock coupling end from sliding off the arrow's nock 68. With the locking mechanism 34 behind the fixed position of the gripper assembly 50 with respect to the nock coupling ends, the amount of tension applied to the arrow (e.g., by pulling it toward the hood member 58 of the quiver) can be increased by pulling the loop formed by the locking mechanism 34 below the gripper assembly 50 while pressing a button on the locking mechanism 34 adapted to remove a frictional force on the cord 32 by the clamping aperture. Then, when the amount of increased tension to more securely hold the arrow 60 in place has been achieved, the button can be released so that the frictional force of the clamping aperture is reapplied to the cord 32. As can be appreciated, with sufficient tension applied, if the shaft of an arrow were to become dislodged from the gripper assembly, the arrow securing device would still hold the arrow securely in the hood member and the arrow will not fall out of the quiver.

Similarly, the amount of tension to the arrow 60 can be reduced by allowing the cord 32 to move toward the arrow nock while pressing the button on the locking mechanism 34 adapted to remove the frictional force on the cord 32 by the clamping aperture. Since the cord 32 is typically comprised of a stretchable resilient material, it will allow for precise adjustment of tensioning suitable to secure the arrow 60 and allow the nock coupling end to be removed or disengaged from the arrow nock 68 by pulling a portion of the nock coupling end. If less tension in the cord 32 is applied, the arrow 60 can removed from the quiver by sliding the arrow 60 up through the gripper assembly 50 until the tip 62 is out of the hood member 58, then pulling the arrow 60 away from the quiver and back down thereby disengaging the nock coupling end without the user having to physically contact it. Such a method of removing or unsecuring the arrow can be advantageous when the user wishes to quickly remove the arrow from the bow quiver and couple it to the bowstring during the hunt. In contrast, a much greater amount of tension such that the arrow cannot be removed without pulling the nock coupling end off of the arrow nock may be desirable in other situations, such as for instance when bow quiver and arrows are in transport.

FIG. 3B provides a close-up view of the gripper assembly 50 and second embodiment arrow securing device 20 attached thereto. In addition to the spacer sections adapted to receive arrow shafts, the gripper assembly 50 can also include a plurality of holes 52. These holes 52 can provide a method of attaching the second embodiment arrow securing device 20 to the gripper assembly 50 of the quiver. The cord 32 can be passed through a hole 52 typically, but not necessarily, prior to the nock coupling end being formed. Depending on the size and structure of the nock coupling end, it may be able to fit though the hole 52. For example, referring briefly to FIG. 4, the nock coupling end comprising an attachment loop 42 and clasp 44 of the version of the first embodiment arrow securing device 10 can typically fit though a hole 52 of the gripper assembly 50.

Also of note illustrated in FIG. 3B is the close-up view of the locking mechanism 34. The button on the locking mechanism 34 adapted to remove the frictional force on the cord 32 and the clamping aperture though which the cord 32 is disposed can be seen more clearly. It is pertinent to note, however, that the locking mechanism can be a variety of structures adapted to lock and typically slidably engage with the cord.

Referring now FIG. 4, a first embodiment arrow securing device 10 coupled to a gripper assembly 50 of a quiver is illustrated whereby the quiver is detached from the bow. A section of the cord 32 extends from the gripper assembly 50 to the back end of the arrow 60 past the fletching 66 whereby the nock coupling end engages with the nock 68. The nock coupling end of the first embodiment arrow securing device 10 can comprises only an attachment loop 42 secured by a clasp 44, which as indicated above makes it easier to thread through a hole of the gripper assembly 50 or other similarly small areas when attaching the arrow securing device to a fixed point on the quiver.

Next, a portion of the attachment loop 42 is slotted into the nock 68 of the arrow 60. With the locking mechanism 34 behind the fixed position of the gripper assembly 50 with respect to the nock coupling end, the amount of tension applied to the arrow 60 can be increased or reduced by pulling the cord 32 proximal the second end or allowing it to move toward the arrow nock 68, respectively, while pressing the button on the locking mechanism 34 adapted to remove a frictional force on the cord 32 by the clamping aperture.

Figure 10:
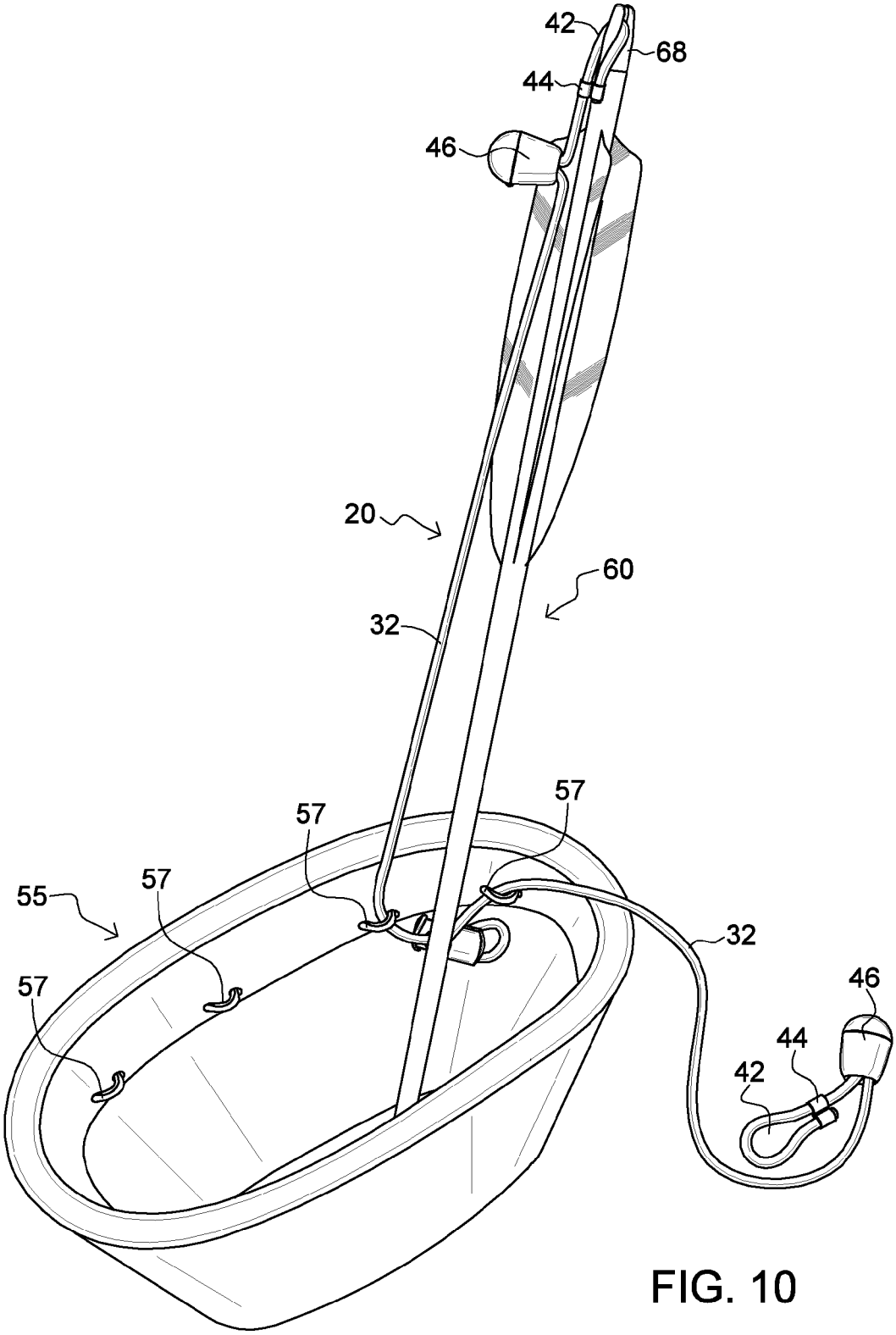
FIG. 10 is a top perspective view of an arrow securing device coupled to a back quiver and an arrow nock according to an embodiment.

FIG. 10 illustrates how a back or shoulder quiver 55 can be used with embodiments of the arrow securing device. The second embodiment arrow securing device 20 can be attached to the quiver 55 via one or more laces 57 disposed along a rim of the quiver 55. To attach the second embodiment arrow securing device 20, the laces 57 can be temporarily loosened so that the nock coupling ends comprising the attachment loop 42 secured by a clasp 44 and a tab member 46 can be fitted through. Or alternatively, all or a portion on the nock coupling end can be constructed after the cord 32 has been threaded through the lace 57. If there are no readily available means to attach the arrow securing device to the quiver, holes may need to be drilled and/or loops/rings attached to provide a fixed point from which to secure the arrow securing device. In such circumstances, it may be advantageous to employ first embodiment arrow securing devices, as the locking mechanism 34 can be removed from the second end allowing the cord 32 to be threaded into tighter areas.

With the second embodiment arrow securing device 20 attached in place to the quiver 55, the first or second nock coupling ends can be removably coupled to the arrow 60 in the quiver 55. For clarity in the illustration only one arrow is shown, but in most implementations a plurality of arrows (see FIG. 8, for example) with a plurality of arrow securing devices would be used in the field or practice range.

Still referring to FIG. 10, a section of the cord 32 extends from the rim of the quiver 55 to the back end of the arrow 60 whereby the first nock coupling end engages with the nock 68 of the arrow. Another section of the cord 32 extends from the rim of the quiver 55 the gripper assembly 50 to the second nock coupling end, which is shown uncoupled from any arrow. With the locking mechanism 34 behind the laces of the quiver 55 with respect to the first nock coupling end, the amount of tension applied to the arrow 60 with its tip in contact with the bottom of the quiver 55 can be similarly increased or reduced as described in the above embodiments by pulling the cord 32 proximal the second end or allowing it to move toward the arrow nock 68, respectively, while pressing the button on the locking mechanism 34 adapted to remove a frictional force on the cord 32 by the clamping aperture.

It is to be appreciated that in many implementations, either the first or second embodiment arrow securing device can be used. For example, the arrow 60 in FIG. 4 could be secured by the first nock coupling end of a second embodiment arrow securing device as opposed to the first embodiment arrow securing device 10 depicted. Similarly, one or more first embodiment arrow securing devices can be used with the quiver 55 as opposed to the second embodiment arrow securing device 20 illustrated in FIG. 10.

Figure 11:
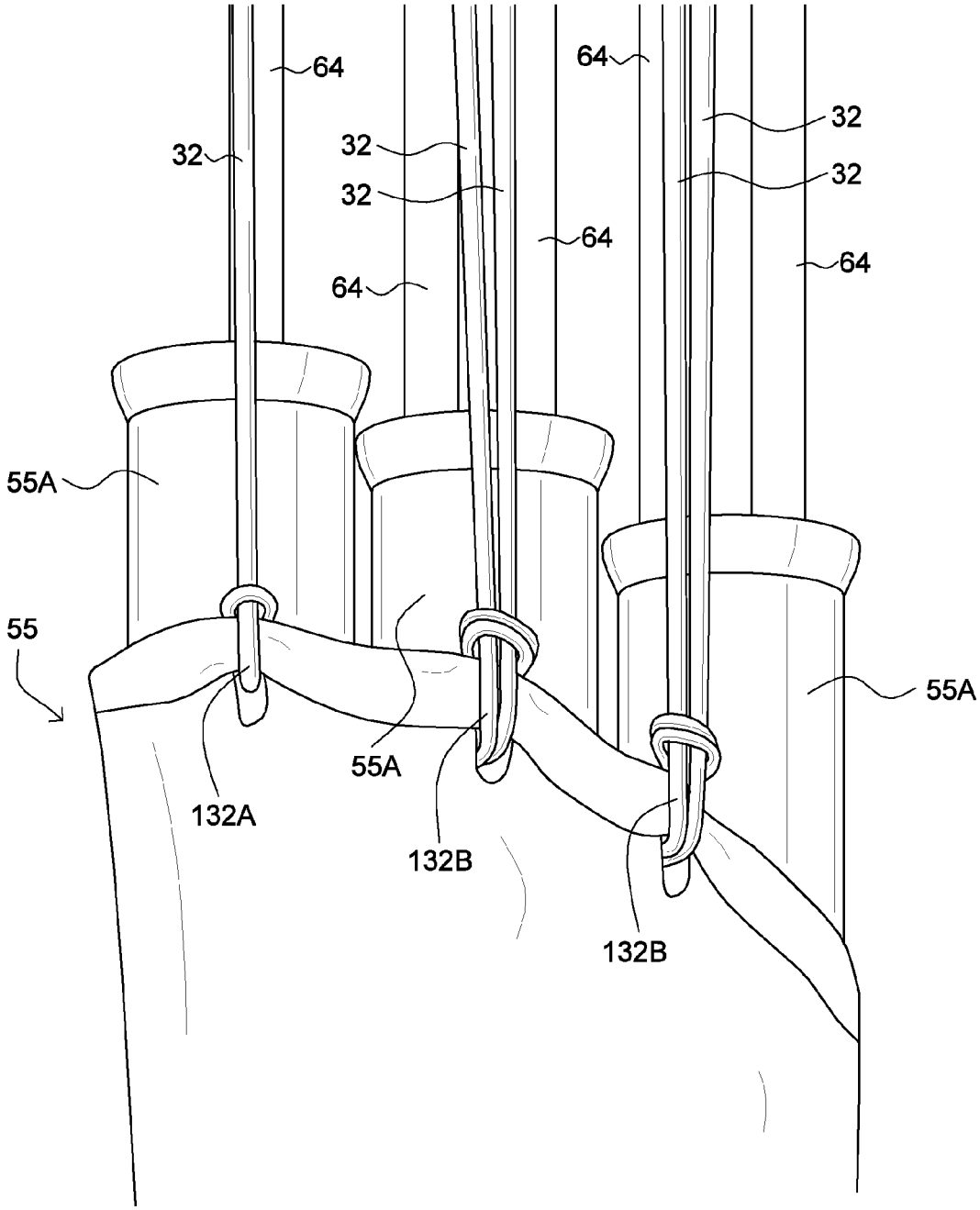
FIG. 11 is a side perspective view of an arrow securing quiver having one or more arrow securing devices according to an embodiment.

Moreover, in various embodiments of the arrow securing device, the locking mechanism 34 may either not be included or may take on a substantially different structure and function than that which is depicted and described above. Referring now to FIG. 11, a knot 132*a* can be tied from cord 32 onto a portion of a quiver 55 in order to anchor or secure a first embodiment arrow securing device. Similarly, knots 132*b* (or like anchoring or attachment points) having at least two cord ends exiting the knot can be tied from cord 32 onto a portion of the quiver 55 in order to anchor or secure a second embodiment arrow securing device. It is to be appreciated that the anchor points of certain embodiments of the arrow securing device can be permanently affixed to a portion of the quiver. By way of example and not limitation, methods such as adhesive bonding, sewing, or integrating the arrow securing device proximal the anchor point can be used to create a novel quiver having one or more arrow securing devices.

As can be seen in FIG. 11, the quiver 55 can include one or more tubes 55*a* to aid in aligning and protecting the arrows therein. The one or more tubes 55*a* can be particularly advantageous when the quiver is constructed of a less rigid material, including relatively supple material such as, but not limited to, woven or non-woven fabric. The shaft 64 of each arrow can be placed into the one or more tubes 55*a* with the tip down and the nock extending out of the one or more tubes 55*a* and quiver 55. The cord 32 extends the nock coupling end of the arrow securing device to the arrow's nock thereby safely securing it within the quiver 55. It is to be understood that embodiments of the arrow securing device can be combined or integrated with numerous types of quivers to create a novel quiver for securing arrows. Quivers for which may be incorporated with embodiments of the arrow securing device include, but are not limited to, back quivers, bow quivers, side quivers, hip quivers, crossbow quivers, target quivers, 3D quivers, and fish arrow quivers.

Figure 12:
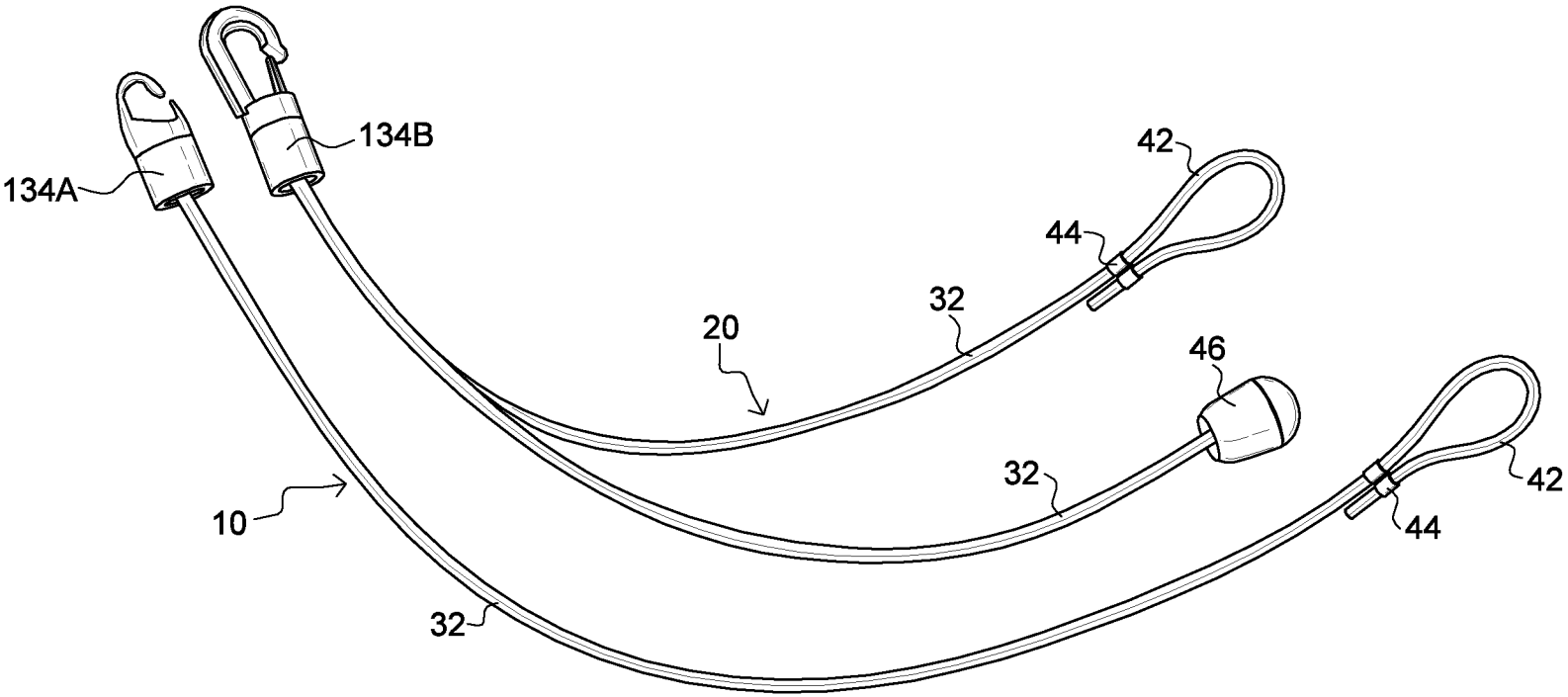
FIG. 12 is a perspective view of arrow securing devices according to variations of a first and second embodiment.

Now referring to FIG. 12, a first embodiment arrow securing device 10 can include a hooking mechanism 134*a* or similar anchor member instead of a locking mechanism 34 (as shown in FIG. 1). The hooking mechanism 134*a* can have an opening area with which can be used to hook onto a portion of a quiver such as a lace or hole thereon, for example. This variation of the first embodiment arrow securing device 10 also typically comprises a stretchable resilient cord 32 and a nock coupling end. The nock coupling end can comprise an attachment loop 42 secured by a clasp 44. However, other nock coupling ends as described and contemplated in this disclosure can also be used. The cord 32 can be a single length of cord having the nock coupling end on a first end and the hooking mechanism 134*a* on a second end.

Similarly, with reference to FIG. 12, a second embodiment arrow securing device 20 can include a hooking mechanism 134*b* or similar anchor member instead of a locking mechanism 34 (as shown in FIG. 2). The hooking mechanism 134*b* can have an opening area with a pivoting clasp member with which can be used to hook onto a portion of a quiver such as a lace or hole thereon, for example. This variation of the second embodiment arrow securing device 20 also typically comprises at least one stretchable resilient cord 32 and at least two nock coupling ends. A first nock coupling end can comprise an attachment loop 42 secured by a clasp 44 and a second nock coupling end can comprise tab member 46. However, as can be appreciated by one having ordinary skill in the art, other nock coupling ends as described and contemplated in this disclosure can also be used. Each cord 32 can be a single length of cord having the nock coupling end on a first end and the hooking mechanism 134*b* on a second end. It is also to be noted that each cord sharing the same hooking mechanism 134*b* or anchor member or point can be of various lengths customized for a specific arrow securing purpose, for example, when arrows of different lengths are stored in a single quiver for an extended hunt.

As described, the hooking mechanisms 134*a*, 134*b* are typically used for arrow securing devices having fixed length cords. However, in some embodiments, the hooking mechanism or like member can also include the function of the locking mechanism 34 or similar apparatus so that the each cord length can be varied.

Moreover, embodiments of the arrow securing device can have three or more nock coupling ends. Each cord of such an embodiment can have a first end, a second end and a longitudinal section disposed therebetween. The first end of each cord can comprise a nock coupling end and the second end of each cord can comprise a locking mechanism or an anchor point or member, such as a hooking mechanism. Also as noted above, the longitudinal section of each cord can be a different length than other cords in such a multi-nock coupling end arrow securing embodiment.

Figure 5A:
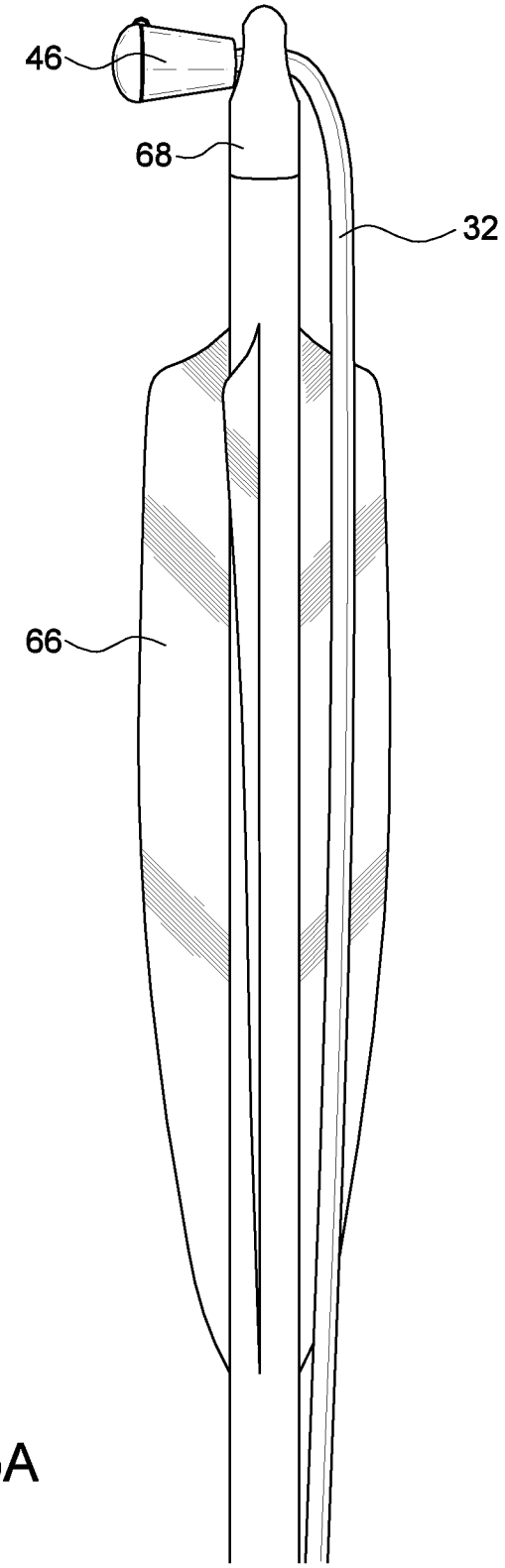
FIG. 5A is a close-up view of an arrow nock and a first version nock coupling end of an arrow securing device removably coupled thereto according to an embodiment.
Figure 5B:
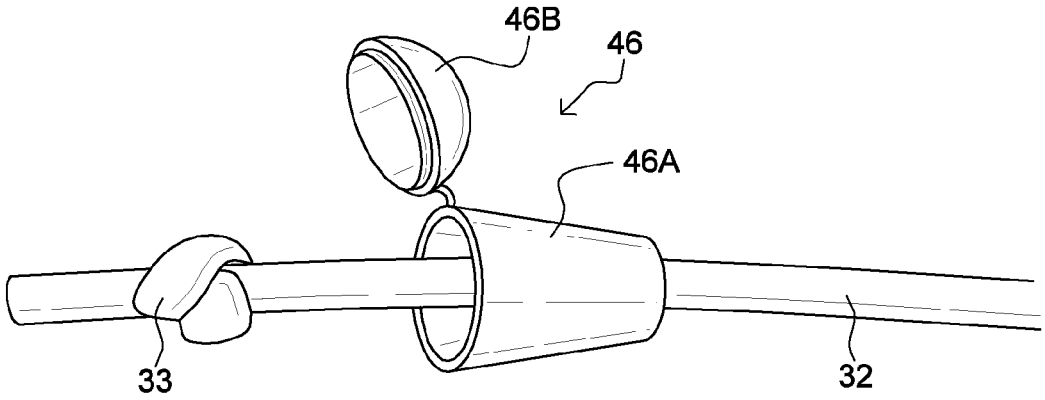
FIG. 5B is a close-up view of a first version nock coupling end of an arrow securing device according to an embodiment.

FIGS. 5A through 8 illustrate in more detail some exemplary nock coupling ends that can be used with embodiments of the arrow securing device. FIG. 5A illustrates a close-up perspective view of a nock coupling end having a tab member 46. The tab member 46 acts as a stopper to prohibit the nock coupling end from sliding off the arrow's nock 68 as well as serves as an object a user can grab to facilitate removal of the cord 32 from the nock 68 when the arrow is to be removed from the quiver. An exploded close-up view of an exemplary tab member 46 is illustrated in FIG. 5B. A knot 33 can be formed proximal an end of the cord 32 after the cord 32 has been placed through an aperture of a hollow section 46*a* with its cap end 46*b* off or open. A first tag end of the knot 33 is disposed proximal an end of the cord 32 and a second tag end of the knot 33 is disposed through the aperture toward the locking mechanism. After a sufficient knot has been formed, the knot 33 and the end of the cord 32 proximal the knot 32 can be enclosed within the hollow section 46*a* by closing its end cap 46*b*.

Figure 6:
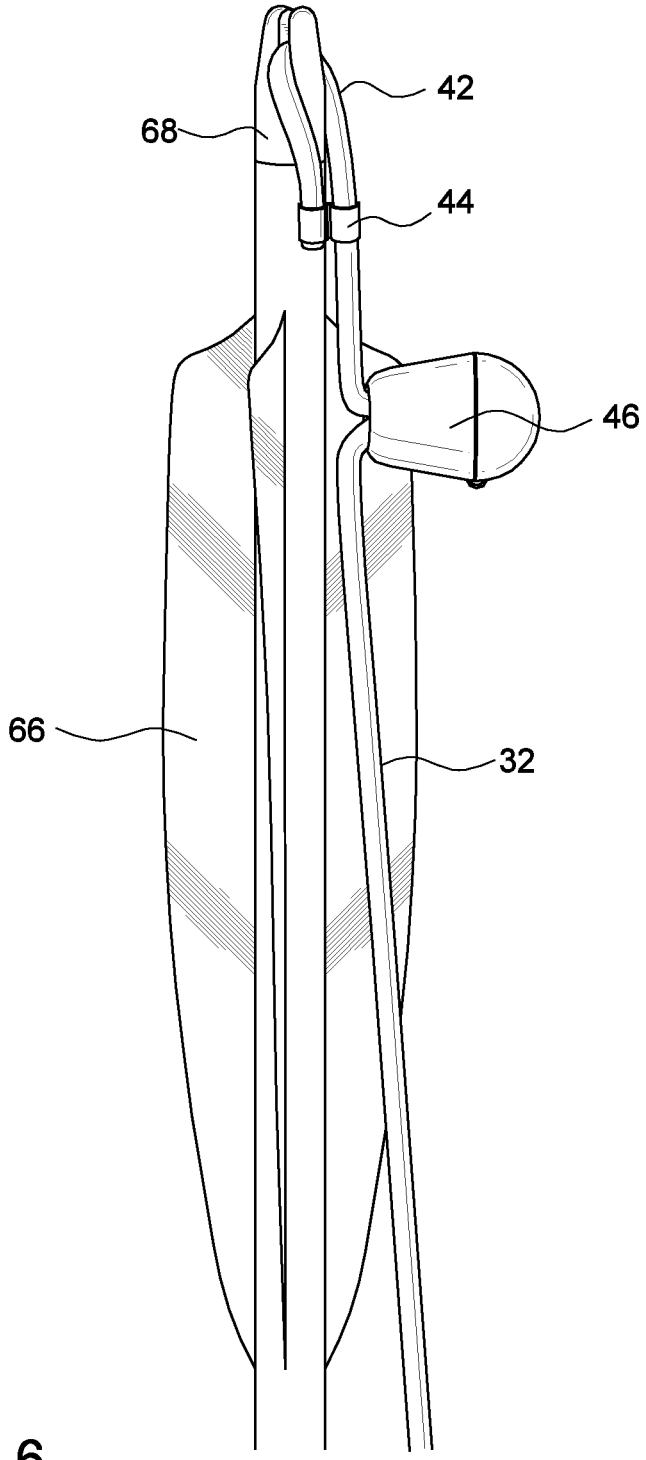
FIG. 6 is a close-up view of an arrow nock and a second version nock coupling end of an arrow securing device removably coupled thereto according to an embodiment.

Referring now to FIG. 6, a nock coupling end comprises an attachment loop 42 secured by a clasp 44, and a tab member 46 is illustrated. As discussed previously with respect to the first and second embodiment arrow securing devices, the tab member 46 is typically disposed proximal the attachment loop 42 in order to facilitate easier removal of the attachment loop 42 from the arrow nock 68.

The knot used to secure the cord within that tab member 46 shown in FIGS. 5A and 6 can be any type of knot sufficient to keep the knotted end from sliding out of the aperture. Moreover, the knot can include a stopping mass of some kind to prohibit the knotted end from sliding. For example, the knot may include a small bored bead with at least a portion of the cord comprising the knot extending through the small bead to increase the overall mass of the small bored bead and knot combination. In some variations, the knot may be replaced completely by a stopping mass. For example, a section of the cord where a knot would typically be disposed could include a stopping mass (e.g., a large split shot lead fishing weight) securely clasped thereto. It is also pertinent to note that additional variations of the nock coupling end show in FIG. 6 can include a knot to create the attachment loop instead of the clasp. This knot similarly be can be any suitable knot, but typically is comprised of a non-slip variety (e.g., a non-slip mono knot) adapted to form a loop.

Figure 7:
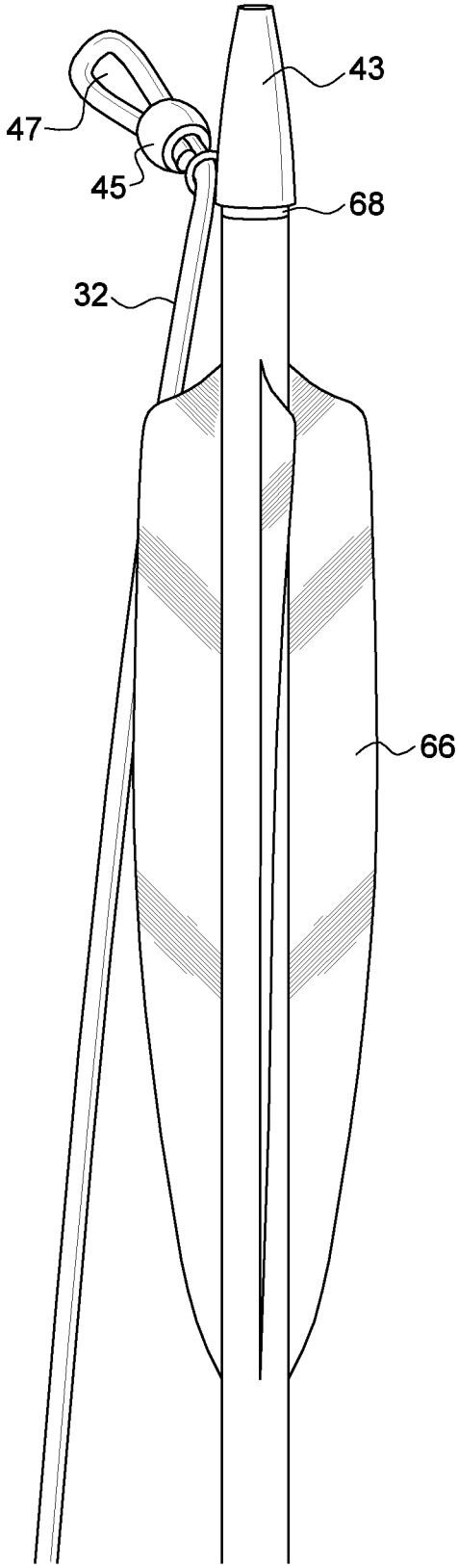
FIG. 7 is a close-up view of an arrow nock and a third version nock coupling end of an arrow securing device removably coupled thereto according to an embodiment.

FIG. 7 is a close-up perspective view illustrating a nock coupling end comprising a nock cap 43 and a tab member disposed proximal the nock cap 43. The tab member in the illustrated version includes a tab loop 47 and a bored bead 45 securing the tab loop 47. The cord 32 can be coupled to the nock cap 43 by threading it though an attached ring portion. As can be deduced from the illustrations of FIGS. 6 and 7, the tab member can be any number of structures located proximal different attachment portion of the nock coupling end. For example, the tab loop 47 and bored bead 45 can be used with and located proximal to the attachment loop 42 secured by the clasp 44, and alternatively the tab member 46 having the aperture, hollow section 46*a*, and cap end 46*b* can be use with and located proximal the nock cap 43.

Figure 8:
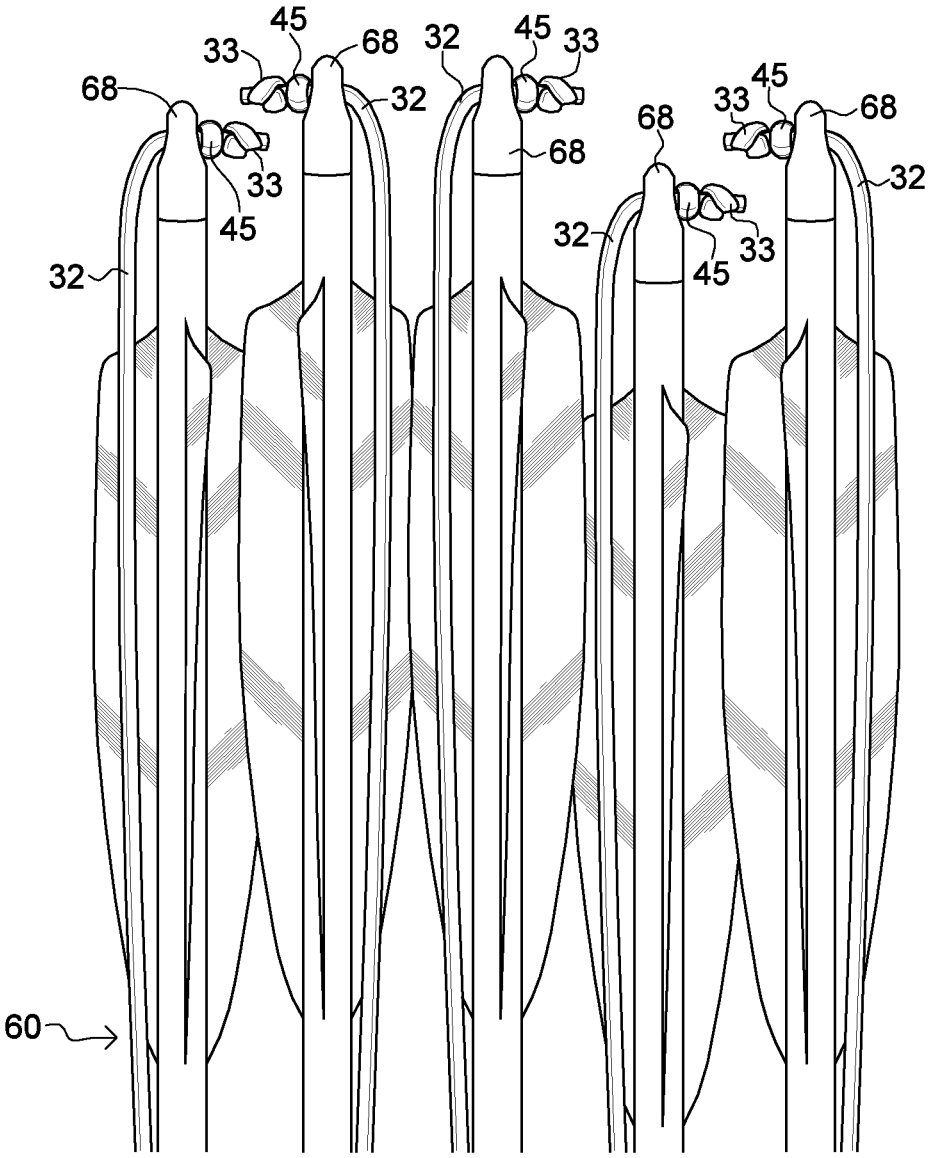
FIG. 8 is a close-up view of a plurality of arrow nocks and fourth version nock coupling ends of arrow securing devices removably coupled thereto according to an embodiment.

FIG. 8 illustrates a plurality of nock coupling ends, each nock coupling end comprising a bored bead 45 secured by a knot 33. The knot 33 securing the bored bead 45 typically has a first tag end disposed toward either the first end or the second end of the cord 32, whichever end comprises the instant nock coupling end, and a second tag end disposed through the bore of the bead toward the locking mechanism. The bored bead is typically, but not necessarily, round or oval shaped and comprised of a plastic material. However, the bored bead can be comprised of any number of shapes and materials function. Non-limiting examples include a bored rectangular piece of stone, a bored square piece of metal or wood, and a piece of bone carved for ornamental purposes with a bore therethrough.

Although one version of the nock coupling end is shown removably coupled to the nocks 68 of the plurality of arrows 60 in FIG. 8, it is to be appreciated that different nock coupling ends can be used to couple a plurality of arrows within the same quiver. This can be particularly advantageous when different arrow types having different lengths, tip sizes, and shaft diameters better suited to be secured to different nock coupling ends are contained within the same quiver.

Figure 9:
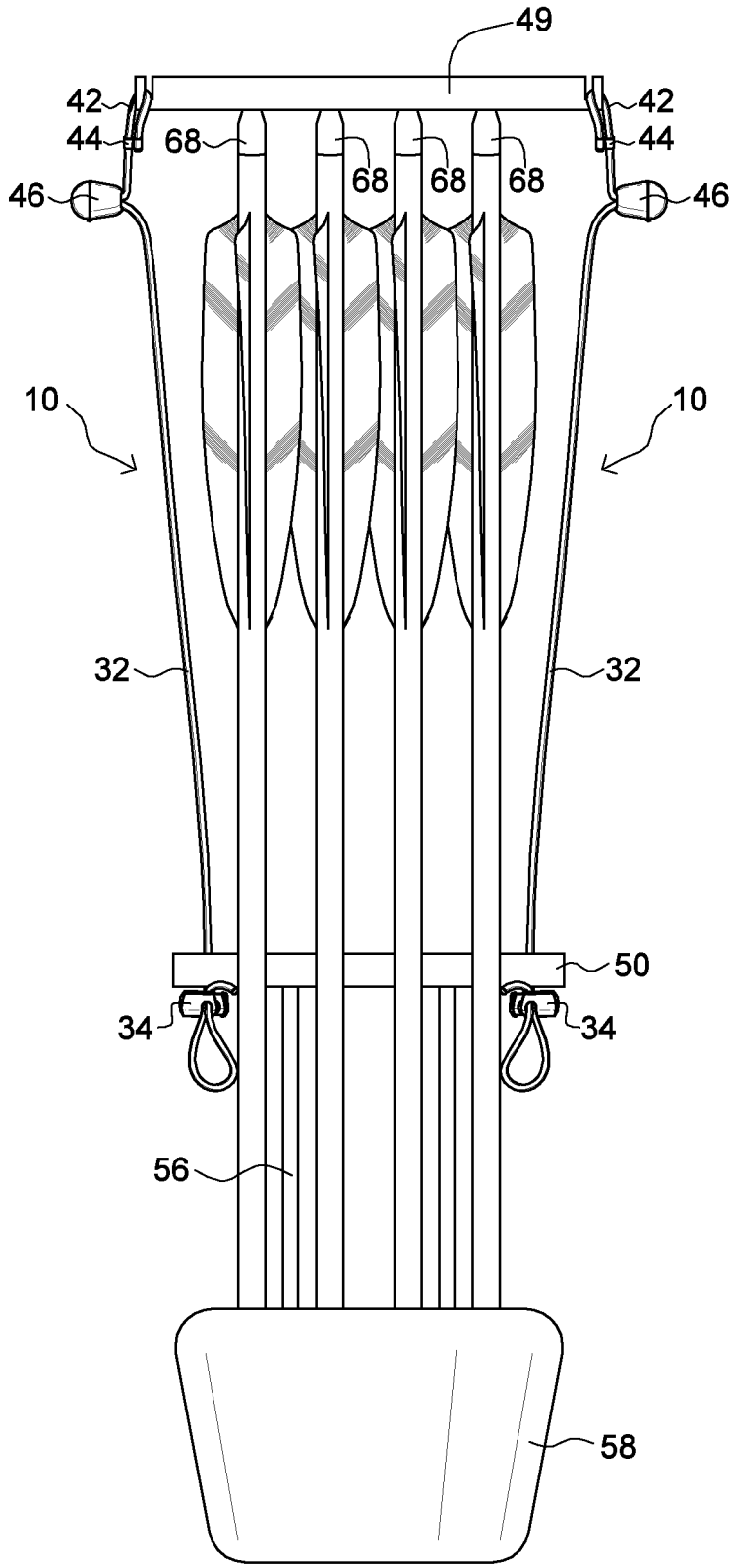
FIG. 9 is side perspective view of an arrow securing device coupled to a plurality of arrows and a quiver according to an alternative embodiment.

Referring now to FIG. 9, an alternative embodiment of the arrow securing device is illustrated. A first embodiment arrow securing device 10 can be disposed on one side of the quiver being coupled to a gripper assembly 50 while having its nock coupling end removably coupled to a nock lid 49 proximal that one side. Similarly, a first embodiment arrow securing device 10 can be disposed on the other side of the quiver being coupled to the gripper assembly 50 while having its nock coupling end removably coupled to the nock lid 49 proximal that other side. The nock lid 49 can have one or more elongated ribs of flanges adapted to couple with a plurality of arrow nocks 68. Preferably, but not necessarily, a version of nock coupling ends having an attachment loop 42 secured by a clasp 44 and a tab member 46 proximal the attachment loop 42 can be used to facilitate easier connection and removal of the nock lid 49.

While the alternative embodiment illustrated in FIG. 9 can be used similarly as an arrow securing embodiment, such an embodiment and versions thereof are most useful when transporting a quiver with arrows therein or when the user is hiking a substantial distance and expects not to have to quickly remove an arrow prior to arrival at his or her destination.

Further variations and alternative embodiments of the arrow securing device are contemplated as would be apparent to one of skill in the art having the benefit of this disclosure. In sum, embodiments of the arrow securing device can be used together with a quiver and arrows therein to create a unique combination adapted to stabilize and safely secure arrows. Therefore, a user can more effectively bow hunt because noise created by arrows contacting each other is minimized or eliminated. Additionally, costly arrows will not be lost while hunting or otherwise moving about thereby reducing the frustration of damaging or losing an arrow as well potential injury from falling on or otherwise contacting an arrow dislodged from the quiver, particularly when the hiking through thick brush or falling down.

An Exemplary Method of Securing One or More Arrows

A new and useful exemplary method of securing one or more arrows in a quiver is disclosed herein. It is to be understood that the first and second embodiment arrow securing devices 10, 20 can be used in conjunction with the exemplary method. By way of example but not limitation, an exemplary embodiment of an arrow securing device typically comprises a stretchable resilient cord, at least one nock coupling end, and a locking mechanism or an anchor point or member. The cord can be a single length of cord that has a first end, a second end, and a longitudinal section disposed therebetween. The locking mechanism can be operatively coupled to the longitudinal section of the cord and releasably lockable thereto. The anchor point can be directly coupled to and/or integrated with a portion of the quiver. Similarly, the anchor member, such as a hooking mechanism, can be removably coupled to a portion of the quiver.

The exemplary method of securing one or more arrows using at least one arrow securing device and a quiver typically comprises the following operations. First, a portion of the cord is secured to a quiver portion of the quiver. The cord portion secured or attached to the quiver portion is typically from the longitudinal section or an end of the stretchable resilient cord proximal the locking mechanism or the anchor member. The quiver portion can be any number of locations on the quiver adapted to attach or anchor the arrow securing device such as but not limited to a hole on a gripper assembly, a lace of the stitching on a body portion of the quiver, or any suitable aperture or looped/ringed appendage on or attached to the quiver.

With the arrow securing device relatively fixed or anchored on a portion of the quiver, the at least one nock coupling end can be attached to a nock of an arrow in the quiver. As described above with respect to the first and second nock coupling devices, the nock coupling end can be any number of structures and combinations thereof adapted to be removably coupled to the arrow's nock.

Next, the locking mechanism can be released thereby allowing the cord to move or slide. By pulling the cord while the locking mechanism is in a released configuration a tension can be applied to the nock of the arrow. The cord is pulled in a direction generally opposite the at least one nock coupling end to increase the amount of tension applied to the nock of the arrow. Once the desired amount of tension has been applied to the arrow nock in order to suitably secure the arrow within the quiver, the locking mechanism can be placed into a locked configuration thereby stopping movement on the cord and retaining the desired tension to the arrow nock. When the arrow is ready for use, the nock coupling end can be removed from the arrow nock allowing it to be easily removed from the quiver.

It is to be appreciated that the exemplary method can be used in conjunction with a plurality of arrow securing devices to secure a plurality of arrows within a variety of quiver types. Moreover, not every arrow within the quiver need be secured with an embodiment of the arrow securing device. For example, some arrows in a bow quiver such as shorter turkey head razor tipped arrows which do not reach the foam bottom of the hood member can be secured with arrow securing devices while other longer point tip arrows can be secured by just the gripper assembly and hood member.

An Exemplary Method of Making Arrow Securing Devices

A new and useful exemplary method of making embodiments of the arrow securing device is additionally disclosed herein. It is to be understood that the first and second embodiment arrow securing devices 10, 20 can be made with this exemplary method of making arrow securing devices.

The exemplary method of making an arrow securing device typically comprises providing a stretchable resilient cord. A particular length of cord is selected to for the given implementation of the arrow securing device. For example, a shorter length of cord can be used when shorter arrows or crossbow bolts are to be secured in a quiver. The cord has a first end, a longitudinal section, and a second end whereby the longitudinal section is disposed between the first and second ends.

Next, at least one nock coupling end is formed proximal either the first end or the second end (or both when each cord end includes a nock coupling end). Moreover, a plurality of cords may be utilized to make an arrow securing device that includes three or more nock coupling ends. It is to be appreciated that the nock coupling end is typically formed prior to attaching the arrow securing device to a quiver; however, the nock coupling end can be formed after the cord has been secured to the quiver (e.g., after an end of the cord has be placed or strung through a small hole of a gripper assembly) in some implementations.

Next, a locking mechanism adapted to releasably lock to can be coupled to the longitudinal section of the cord. Moreover, when both ends of the cord comprise nock coupling ends, the locking mechanism is coupled to two portions of the longitudinal section of the cord forming a loop along a portion of the longitudinal section. Alternatively, an anchor member, such as a hooking mechanism, can be coupled to the opposite end of the nock coupling end, or the longitudinal section of the cord when a single cord is used and the first and second ends each include a nock coupling end.

Further, when making an arrow securing quiver, an anchor point can be created on a portion of a quiver similar to the anchor member. Hence, the arrow securing quiver can be made by providing a quiver and providing a stretchable resilient cord having a first end, a longitudinal section, and a second end whereby the longitudinal section is disposed between the first and second ends. Then, a portion of the cord such as an end can be secured to a portion of the quiver creating an anchor point for the arrow securing device. Next, at least one nock coupling end is formed proximal either the first end or the second end (or both when each cord end includes a nock coupling end).

It is to be appreciated that the method of making arrow securing devices and quivers is merely exemplary. Variations of this method can be used to make different embodiments of the nock securing device as would be apparent to one of ordinary skill given the benefit of this disclosure.

Alternative Embodiments and Variations

The various embodiments and variations thereof, illustrated in the accompanying figures and/or described above, are merely exemplary and are not meant to limit the scope of the invention. It is to be appreciated that numerous other variations of the invention have been contemplated, as would be obvious to one of ordinary skill in the art, given the benefit of this disclosure.

For example, in embodiments designed for children the cord can be include reflective material making the child's bow and bow quiver more visible to the supervising adult. It is to be further appreciated that various embodiments of the arrow securing device can comprise cords and parts having numerous colors such as, but not limited to, black, florescent orange, yellow, and green, and camouflage green, olive, brown, grey, and white.

Moreover, in some variations the nock coupling end may not be an actual end of cord, but is typically proximal an end. For example, in at least one variation the nock coupling end is proximal an end of the cord and a remainder of the cord is coupled to an implement such as, but not limited to, a feather or other ornamental implement, camouflage, or a tool. Additionally, it is to be appreciated that embodiments of the arrow securing device can be enlarged and adapted to secure heavy fiberglass bow fishing arrows as well as other arrow types and functions.

In yet another alternative embodiment, the arrow securing device can comprise: a plurality of cords, each cord having a first end, a longitudinal section, and a second end; at least one nock coupling end proximal at least one of the first end and the second end of each cord; and a one of an anchor point and an anchor member operatively coupled to at least one of the first end and the second end of each cord opposite the at least one nock coupling end. The one of the anchor point and the anchor member can be adapted to couple the plurality of cords to a portion of a quiver.

All variations disclosed in this application are intended and contemplated to be within the spirit and scope of the invention.

I claim:

1. A method of securing an arrow in a quiver comprising:
providing an arrow securing device including:
a cord having a first end, a longitudinal section, and a second end;
at least one nock coupling end proximate at least one of the first end and the second end; and
an anchor point selected from the group consisting of an anchor member and a locking mechanism, the anchor point being operatively coupled to the cord and adapted to couple the cord to a portion of a quiver;
securing the anchor point to the portion of the quiver by passing a portion of the cord through the nock; and
attaching the at least one nock coupling end to a nock of an arrow in the quiver.

2. The method recited in claim 1, wherein said securing the anchor point to the portion of the quiver comprises passing the cord through a hole in a gripper assembly coupled to the quiver.

3. The method recited in claim 1, wherein said securing the anchor point to the portion of the quiver comprises securing the anchor point to a body section of the quiver.

4. The method recited in claim 1, wherein the at least one nock coupling end includes a tab member disposed proximate either or both of the first end and the second end.

5. The method recited in claim 4, wherein:
the tab member includes a cap end openably coupled to a hollow section, the hollow section including an aperture through which the cord resides; and
the tab member is secured to the cord by a knot residing within the hollow section.

6. The method recited in claim 4, wherein only one portion of the cord passes through the aperture.

7. The method recited in claim 1, wherein the at least one nock coupling end includes a loop disposed proximate either or both of the first end and the second end.

8. The method recited in claim 1, wherein the at least one nock coupling end includes a tab member disposed proximate the first end and a loop disposed proximate the second end.

9. The method recited in claim 8, wherein:
the tab member includes a cap end openably coupled to a hollow section, the hollow section including an aperture through which the cord resides; and
the tab member is secured to the cord by a knot residing within the hollow section.

10. The method recited in claim 1, wherein (i) the at least one nock coupling end comprises a first nock coupling end proximal the first end and a second nock coupling end proximal the second end, and (ii) the anchor point is operatively coupled to two portions along the longitudinal section of the cord.

11. The method recited in claim 1, wherein the anchor point comprises a hooking mechanism.

12. A method of securing an arrow in a quiver comprising:
providing an arrow securing device including:
a cord having a first end, a longitudinal section, and a second end;
at least one nock coupling end proximate at least one of the first end and the second end; and
a locking mechanism operatively coupled to the cord, the locking mechanism being adapted to releasably lock the cord along the longitudinal section;
securing a portion of the longitudinal section of the cord to the quiver, the portion of the longitudinal section residing proximate the locking mechanism;
attaching the at least one nock coupling end to a nock of an arrow in the quiver;
releasing the locking mechanism operatively coupled to the cord;
applying tension to the nock of the arrow by pulling the cord while the locking mechanism is in a released configuration; and locking the locking mechanism, thereby retaining the tension to the nock of the arrow.

13. The method recited in claim 12, wherein said securing the portion of the longitudinal section to the quiver comprises securing the portion of the longitudinal section to a gripper assembly via a hole in the gripper assembly.

14. The method recited in claim 12, wherein said securing the portion of the longitudinal section to the quiver comprises securing the portion of the longitudinal section to a body section of the quiver.

15. The method recited in claim 12, wherein said attaching the at least one nock coupling end to the nock of the arrow includes passing a portion of the cord through the nock.

16. A method of securing a plurality of arrows in a quiver comprising:

providing an arrow securing device including:

a cord having a first end, a longitudinal section, and a second end;

at least one nock coupling end proximate at least one of the first end and the second end;

a locking mechanism operatively coupled to the cord, the locking mechanism being adapted to releasably lock the cord along the longitudinal section, wherein, (i) the at least one nock coupling end comprises a first nock coupling end proximal the first end and a second nock coupling end proximal the second end, and (ii) the locking mechanism is operatively coupled at two locations along the longitudinal section, forming a loop in the cord;

securing a portion of the longitudinal section to the quiver, the portion of the longitudinal section residing proximate the locking mechanism;

attaching the first nock coupling end to a first arrow nock;

attaching the second nock coupling end to a second arrow nock;

releasing the locking mechanism;

applying tension to the first arrow nock and the second arrow nock by pulling the loop while the locking mechanism is in a released configuration; and locking the locking mechanism, thereby retaining the tension to the first and second arrow nocks.

17. The method recited in claim 16, wherein said securing the portion of the longitudinal section includes securing the portion of the longitudinal section to a gripper assembly via first and second holes in the gripper assembly.

18. The method recited in claim 16, wherein said securing the portion of the longitudinal section comprises securing the portion of the longitudinal section to at least one lace in a body section of the quiver.

19. The method recited in claim 16, wherein said attaching the at least one nock coupling end to the nock of the arrow in includes passing a portion of the cord through the nock.

* * * * *